United States Patent [19]

Roux

[11] 4,448,330

[45] May 15, 1984

[54] DISPENSER DEVICES FOR FLOWABLE CONTENTS IN COMPRESSIBLE TUBES

[76] Inventor: Pieter Roux, 6 Resevoir St., Malmesbury, South Africa, 7300

[21] Appl. No.: 337,968

[22] Filed: Jan. 8, 1982

[51] Int. Cl.[3] ..... B65D 35/28

[52] U.S. Cl. ..... 222/101; 222/103

[58] Field of Search ..... 222/97, 98, 101, 102, 222/103; 251/6, 9, 10

[56] References Cited

U.S. PATENT DOCUMENTS

| | | | |
|---|---|---|---|
| 2,056,422 | 10/1936 | Crossley | 222/101 |
| 2,530,327 | 11/1950 | Derrick | 222/101 X |
| 2,620,092 | 12/1952 | Berglund | 222/103 |
| 4,015,750 | 4/1977 | Wilston | 222/103 |

FOREIGN PATENT DOCUMENTS

| | | | |
|---|---|---|---|
| 124759 | 4/1949 | Sweden | 222/103 |

*Primary Examiner*—F. J. Bartuska

*Attorney, Agent, or Firm*—Pearne, Gordon, Sessions, McCoy, Granger & Tilberry

[57] ABSTRACT

A dispenser device for dispensing flowable contents from a compressible tube. The device includes a support having a base plate; a curved compressor body; a shaft rotatably supporting the compressor body and having a pivotable connection on the support so as to define a gap between the compressor body and the base plate. A compressible tube can be inserted into the gap. The device further has a manually operable handle connected to the compressor body. The handle, on rotation, is adapted to move the compressor body towards the base plate for exerting pressure on a tube placed between the compressor body and the base plate so as to force the flowable contents out of the tube.

4 Claims, 3 Drawing Figures

DISPENSER DEVICES FOR FLOWABLE CONTENTS IN COMPRESSIBLE TUBES

BACKGROUND OF INVENTION

1. Field of the Invention

The present invention relates to dispenser devices.

More particularly, the invention relates to dispenser devices for dispensing the flowable contents from compressible tubular containers, such as toothpaste tubes.

A problem generally encountered with compressible tubular containers, such as toothpaste tubes, is to get all the paste out of the tube. This often is cumbersome and therefore such a tube mostly is thrown away even if a substantial amount of paste still remains in the tube. Obviously this results in unnecessary waste.

It is an object of the invention to suggest a device for assisting in overcoming this problem.

2. Brief Description of the Invention

According to the invention, a dispenser device for dispensing flowable contents from a compressible tube includes a support having a base plate; a curved compressor body; a connection means rotatably supporting the compressor body and having a pivotable connection on the support so as to define a gap between the compressor body and the base plate into which gap a compressible tube can be inserted; and a manually operable handle connected to the compressor body, which handle, on rotation, is adapted to move the compressor body towards the base plate for reducing the gap and thereby exerting pressure on a tube placed between the compressor body and the base plate so as to force the flowable contents out of the tube.

Biasing means may be provided between the base plate and the compressor body. The base plate may be movably mounted on the support, and the biasing means may be adapted to act between the base plate and the support. Alternatively, the biasing means may act between the pivotable connection of the compressor body on the support and the base plate.

The biasing means may be in the form of at least one coil spring.

The compressor body may be in the form of an elongated cylinder, which may be mounted off-center rotatably to the connection means, which may include a pair of arms, the arms in turn being pivotably connected to the support.

A spring may be provided acting between the handle and the support urging the compressor body into an inoperative position.

The base plate may be curved.

DESCRIPTION OF THE DRAWINGS

The invention will now be described by way of example with reference to the accompanying schematic drawings.

In the drawings there is shown in

Figure 1:
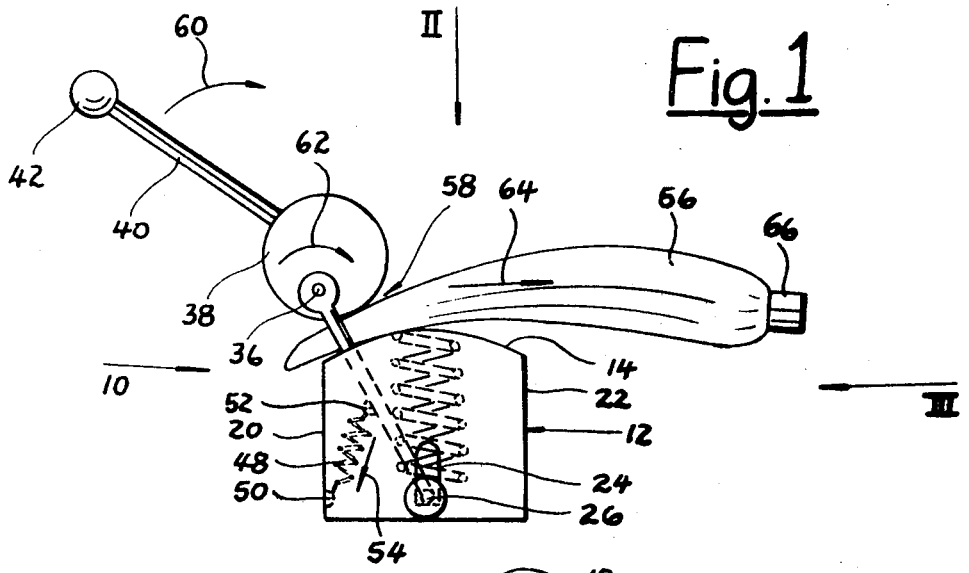
FIG. 1 a side view of a dispenser device in accordance with the invention, and with a tube in position for dispensing.
Figure 2:
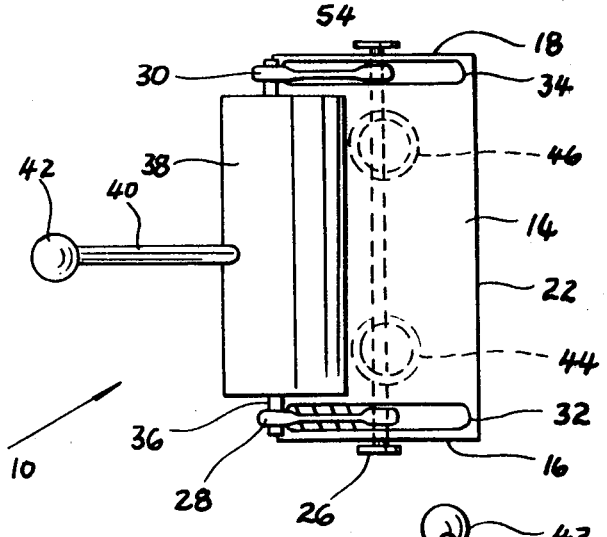
FIG. 2 a plan view of the device seen along arrow II in FIG. 1, but without a tube in position.
Figure 3:
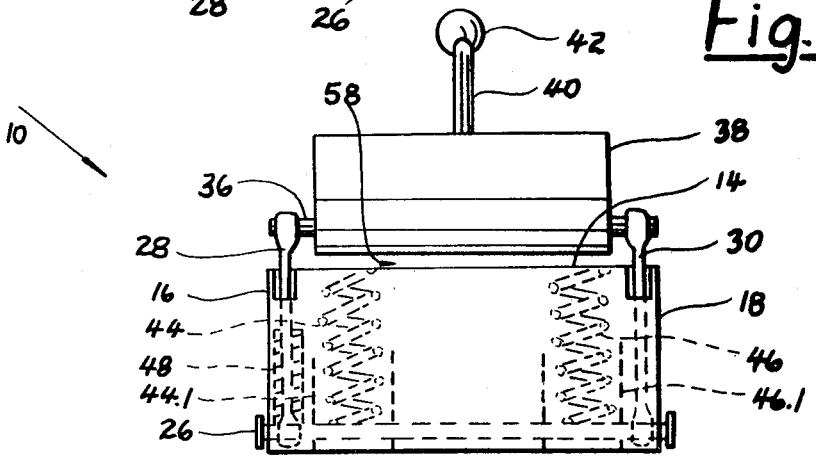
FIG. 3 a front view of the device seen along arrow III in FIG. 1, and also without a tube in position.

Referring to the drawings, the dispenser device 10 includes a support housing 12 having a curved base plate 14 with two end plates 16 and 18 and two side plates 20 and 22.

In the end plates 16 and 18 vertical slots 24 are provided in which a base shaft 26 is slidable. The base shaft 26 is connected to two arms 28 and 30, which are adapted to slide along two elongated slots 32 and 34 provided in the curved base plate 14.

The free ends of the arms 28 and 30 are rotatably connected to a shaft 36, which is attached to a compressor body in the form of a cylinder 38. The shaft 36 is located off-center to the cylinder 38. The cylinder 38 is freely rotatable about the shaft 36.

The connection means includes the base shaft 26, the two arms 28,30 and the shaft 36.

The cylinder 38 has a manually operable handle 40 with a handle knob 42 at its free end.

Two coil springs 44 and 46 act between the base shaft 26 and the underside of the base plate 14. Furthermore a spring 48 is attached at one end 50 to the side plate 20 of the housing 12 and at the other end 52 to the arm 28 to pull it in the direction indicated by arrow 54 into an inoperative position or a position of rest as shown in the drawings.

When operating the device, the rear, closed end of a compressible or collapsible tube 56 containing flowable material, such as a toothpaste tube, is placed into position as shown in FIG. 1. The closed end of the tube 56 projects through the gap 58 defined between the cylinder 38 and the curved base plate 14. By moving the handle 40 in the direction indicated by arrow 60 the cylinder 38 will be rotated about the shaft 36 in the direction indicated by arrow 62. Thereby the cylinder 38 will move closer to the plate 14, reducing the width of the gap 58 and thus press onto the tube 56 forcing it against the curved plate 14. The contents of the tube 56 will be forced in the direction of arrow 64 towards the outlet 66 of the tube 56.

The springs 44 and 46 are provided to ensure the necessary resiliency, to allow for various sizes of tubes and to prevent damage to the tube 56. Guide tubes 44.1 and 46.1 are provided for respectively guiding the springs 44, 46.

All of the parts of the device 10 may be made of metal or of synthetic plastics material.

In an alternative embodiment, the shaft 26 may be fixed to the housing 12, and the plate 14 may be provided slidably in the housing with the springs 44, 46 then acting between the plate 14 and the housing.

I claim:

1. A dispenser device for dispensing flowable contents from a compressible tube, which includes a support having a base plate; a curved compressor body in the form of an elongated cylinder, which is mounted off-center rotatably to a pair of arms, which arms in turn are pivotably connected to the support; a connection means rotatably supporting the compressor body and having a pivotable connection on the support so as to define a gap between the compressor body and the base plate, into which gap a compressible tube can be inserted; a manually operable handle connected to the compressor body, which handle, on rotation, is adapted to move the compressor body towards the base plate for reducing the gap thereby exerting pressure on a tube placed between the compressor body and the base plate so as to force the flowable contents out of the tube and a spring provided acting between the support and at least one of the arms so as to urge the compressor body into an inoperative position.

2. A device as claimed in claim 1, in which biasing is provided between the base plate and the compressor body.

3. A device as claimed in claim 2, in which the base plate is movably mounted on the support, and in which the biasing means is adapted to act between the base plate and the support.

4. A device as claimed in claim 2, in which the base plate is curved.

* * * * *